US009640888B2

(12) United States Patent
Beaman et al.

(10) Patent No.: US 9,640,888 B2
(45) Date of Patent: May 2, 2017

(54) PREVENTING CORROSION OF AN ELECTRICAL CONNECTOR

(71) Applicant: Lenovo Enterprise Solutions (Singapore) Pte. Ltd., Singapore (SG)

(72) Inventors: Brian S. Beaman, Apex, NC (US); Daniel P. Kelaher, Holly Springs, NC (US); Kevin J. Perveiler, Wake Forest, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 180 days.

(21) Appl. No.: 14/562,202

(22) Filed: Dec. 5, 2014

(65) Prior Publication Data

US 2016/0160360 A1 Jun. 9, 2016

(51) Int. Cl.

| | |
|---|---|
| ***C23F 13/02*** | (2006.01) |
| ***H01R 13/03*** | (2006.01) |
| ***C23F 13/20*** | (2006.01) |
| *H01R 13/11* | (2006.01) |
| *C23F 13/18* | (2006.01) |

(52) U.S. Cl.

CPC ..... *H01R 13/03* (2013.01); *C23F 13/20* (2013.01); *C23F 13/18* (2013.01); *C23F 2213/30* (2013.01); *H01R 13/11* (2013.01)

(58) Field of Classification Search

CPC ..... C23F 13/02; C23F 13/06; C23F 13/08; C23F 13/10; C23F 13/16; C23F 2213/30–2213/32; H01R 13/00; H01R 13/03; H01R 13/10–13/14; H01R 13/40; H01R 13/62

See application file for complete search history.

(56) References Cited

U.S. PATENT DOCUMENTS

| | | | | |
|---|---|---|---|---|
| 8,398,418 | B2 | 3/2013 | Nobile et al. | |
| 8,585,448 | B2 | 11/2013 | Timsit | |
| 2008/0193743 | A1* | 8/2008 | Kruse | C08K 3/08 428/332 |
| 2010/0311286 | A1* | 12/2010 | Schrader | H01R 13/18 439/839 |

(Continued)

FOREIGN PATENT DOCUMENTS

JP 2004192954 7/2004

OTHER PUBLICATIONS

Amspec (2011 [https://web.archive.org/web/*/http://www.amspec.net/products/metal-anodes/tin-anodes/], http://www.amspec.net/products/metal-anodes/tin-anodes/).*

*Primary Examiner* — Luan Van
*Assistant Examiner* — Alexander W Keeling
(74) *Attorney, Agent, or Firm* — Lieberman & Brandsdorfer, LLC

(57) ABSTRACT

Embodiments of the invention relate to a primary contact or primary body comprising of a primary material with a propensity to corrode. A location on a surface of the primary body is an active location and functions to interface with a secondary body. The active location has a first surface and an oppositely disposed second surface. An anode material is applied to the second surface adjacent to the active location on the first surface. The primary body is exposed to a corrosive material. The anode material functions to divert a galvanic corrosive medium from the active location to the applied anode material.

20 Claims, 4 Drawing Sheets

(56) References Cited

U.S. PATENT DOCUMENTS

2011/0014825 A1* 1/2011 Drew ..... H01R 13/03
439/877
2012/0264321 A1 10/2012 Siebens et al.

* cited by examiner

PREVENTING CORROSION OF AN ELECTRICAL CONNECTOR

BACKGROUND

The present invention relates to preventing or mitigating galvanic corrosion. More specifically, the invention relates to employment of a sacrificial anode material in communication with a surface subject to galvanic corrosion, with the sacrificial anode material diverting galvanic corrosive flow.

Corrosion is a gradual process of destruction of metallic materials by chemical reaction. A common form of corrosion is associated with oxidation of metallic material. Corrosion degrades useful properties of materials and structures, including strength, appearance, and permeability to liquids and gases. Corrosion of electrical or electronic connector pins and shells is a source of degraded system operation and failure. Problems with corrosion are prevalent in conditions associated with moisture, chemicals that enable the corrosion, and corrosive contaminants.

Current solutions to corrosion of connector pins and shells include, but are not limited to, gold plating and/or chemically coating with a substance to retard the corrosion process. Repairs associated with corrosion include replacement of the failed part, such as replacement of a connector, or replacement of an entire electronic or electrical device.

SUMMARY

The invention includes a method, apparatus, and connector for a passive solution to galvanic corrosion.

An apparatus, method, and connector are provided for mitigating galvanic corrosion through use of a sacrificial material. A contact that may be subject to galvanic corrosion is provided. The contact has a body comprised of a primary material with a propensity to corrode. More specifically, the contact is configured with a proximal end and an oppositely disposed distal end. A resilient section is provided within the contact between proximal and distal ends, with the resilient section having a first surface adapted to mate with a secondary body, and an oppositely disposed second surface. An anode material is applied to or otherwise in communication with the second surface. The anode material functions as a sacrificial material to attract galvanic corrosion and to divert the galvanic corrosion from an active area adjacent to the anode material.

Other features and advantages of this invention will become apparent from the following detailed description of the presently preferred embodiment(s) of the invention, taken in conjunction with the accompanying drawings.

BRIEF DESCRIPTION OF THE SEVERAL VIEWS OF THE DRAWINGS

The drawings referenced herein form a part of the specification. Features shown in the drawings are meant as illustrative of only some embodiments of the invention, and not of all embodiments of the invention unless otherwise explicitly indicated.

DETAILED DESCRIPTION

Figure 1:
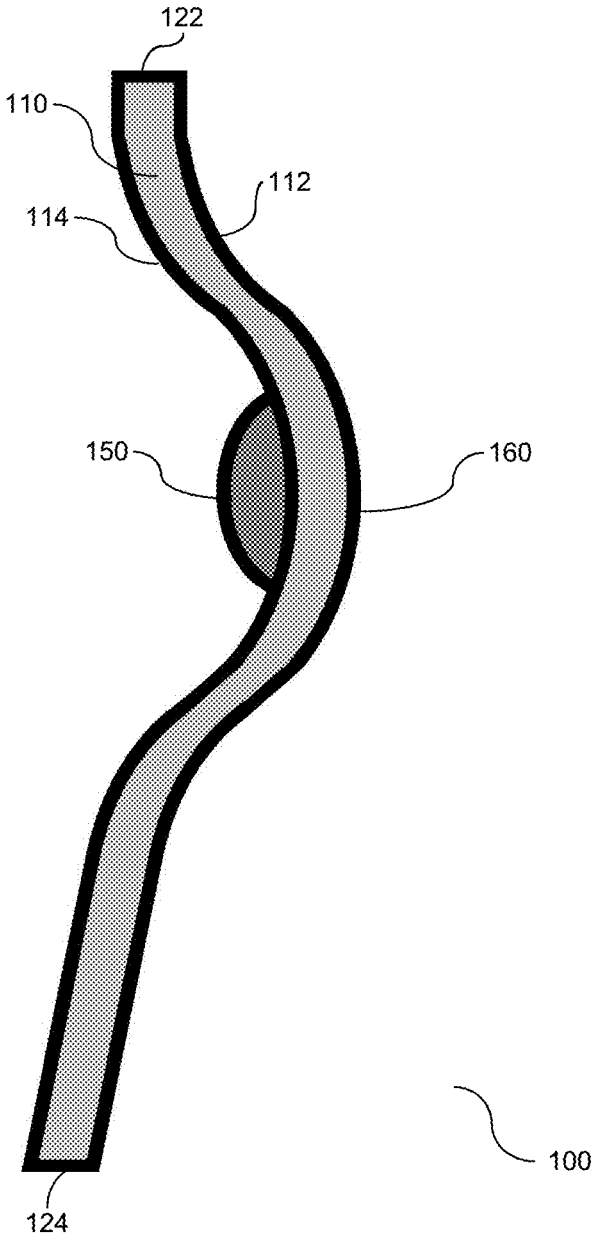
FIG. 1 depicts a block diagram illustrating a cantilever spring contact for an electrical connector.

It will be readily understood that the components of the present invention, as generally described and illustrated in the Figures herein, may be arranged and designed in a wide variety of different configurations. Thus, the following detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily referring to the same embodiment.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

Galvanic corrosion is a specific category of corrosion associated with dissimilar metals and alloys that have different electrode potentials. When two or more of the metals or alloys, also referred to herein as a galvanic couple, come into contact with an electrolyte, one metal acts as an anode and the other metal acts as a cathode. An electro-potential difference between the dissimilar metals is the driving force for an accelerated attack on the anode member of the galvanic couple. The anode metal dissolves into the electrolyte, and a deposit collects on the cathode metal.

Under high humidity conditions, surface films on contact surfaces can act as a galvanic cell and cause galvanic corrosion between a base alloy or a base conductive alloy and a different plating metallurgy. Many electrical connectors used in computing or digital electronic applications are designed for high density connections with relatively low contact forces. Due to the low contact forces, the connections are sensitive to even low levels of corrosion film that form on the surface of an associated contact, and can cause open connections and system failures.

A galvanic anode, also referred to herein as a sacrificial anode, is utilized herein to prevent corrosion of electrical connectors. The use of the sacrificial anode is a passive solution to galvanic corrosion in that protection is provided without any additional intervention. For a galvanic anode to function effectively, it requires both a physical electrical connection between the sacrificial component and the component being protected, and a separate ionic connection between these components. The sacrificial anode maintains electrical conductivity versus maintaining structural integrity. Employment of the sacrificial anode is in a dynamic environment where maintenance of mobility and connectivity is supported.

With reference to FIG. 1, a block diagram (100) is provided illustrating a cantilever spring contact for an electrical connector. As shown, the contact includes an elongated body (110), which is shown with two opposing surfaces (112) and (114), also referred to herein as a first surface and an oppositely disposed second surface, respectively. The first surface (112) is also referred to as a connector mating surface, and is adapted to mate with a connector (not shown). The body also includes two oppositely disposed ends, including a first end (122) and a second end (124). A galvanic sacrificial anode material (150) is in communication with the body (110) on the second surface (114), also referred to as an inactive surface. In one embodiment, the sacrificial material (150) is a zinc compound. Similarly, in one embodiment, the sacrificial material (150) is placed on an area of the inactive second surface (114) oppositely disposed from a position of the first surface (112) having a point or area of contact (160) with a secondary interface. The body (110) is comprised of a metallic material. The galvanic sacrificial anode material (150) is comprised of a material with a greater propensity to corrode than the material of the body (110) in which that the material (150) is protected from galvanic corrosion. In one embodiment, the sacrificial material (150) specifically protects the body (110) from all forms of corrosion on connector surfaces, including galvanic and chemical, e.g. oxidation. The sacrificial material (150) attracts galvanic corrosion. More specifically, the sacrificial material (150) corrodes first, thereby preventing degradation of associated connector points. Accordingly, by directing the corrosion to the sacrificial material (150), the life of the contact body (110) is extended, together with reliability of an associated connector in communication with the body (110).

Figure 2:
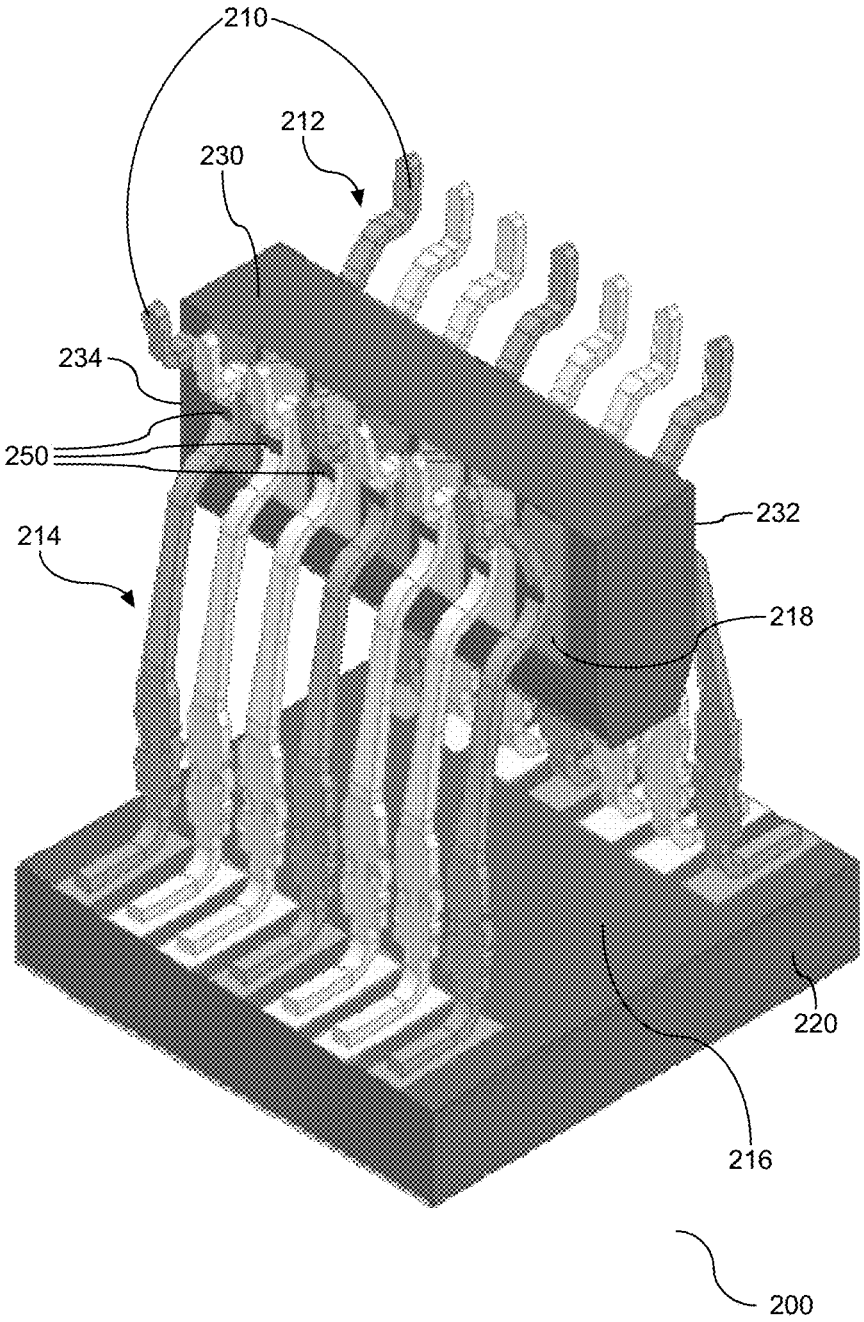
FIG. 2 depicts an exploded perspective view of a connector.

Referring to FIG. 2, an exploded perspective view (200) of a connector is provided. As shown, a plurality of cantilever spring contacts (210) is arranged in communication with a printed circuit board (220). More specifically, the contacts (210), based on the configuration and description provided in FIG. 1, have a cantilever configuration with a resilient property. The contacts (210) are arranged in two parallel rows (212) and (214), with an opening (216) formed between the rows. A secondary board (230) is shown being received by the contacts (210), and specifically being received in the opening (216) formed by the rows (212) and (214) of the contacts. Each of the contacts (210) is configured with a resiliency. Similarly, the secondary board (230) is configured with two oppositely disposed exterior surfaces (232) and (234). As shown, surface (232) is received adjacent to row (212) and surface (234) is received adjacent to row (214). The resiliency of the contacts (210) enables the contacts in each row to be mechanically connected to the received secondary board (230). In addition, the contacts (210) electrically communicate with the received secondary board (230). Accordingly, the contacts (210) are arranged and configured on a printed circuit board (220).

As shown in FIG. 1, the contacts (210) are each provided with two oppositely disposed surfaces. In one embodiment, one surface is referred to as an active surface and one side is referred to as an inactive surface. The sacrificial anode material (250) is positioned on the inactive surface adjacent to an area of the active surface that is in receipt or in communication with the received secondary board (230). The sacrificial anode material (250) is shown in the contacts (210) arranged in communication with the circuit board (220) and the received secondary board (230). As shown, the active surface of the contacts (210) is in communication with the received secondary board (230) at (218) and on an opposite surface from the sacrificial anode material (250). Accordingly, as shown herein, the connector is shown with contacts arranged to receive a secondary board (230) and with sacrificial anode material to divert corrosion away from the contact, and more specifically, from the surface of the contact receiving the secondary board (230).

Figure 3:
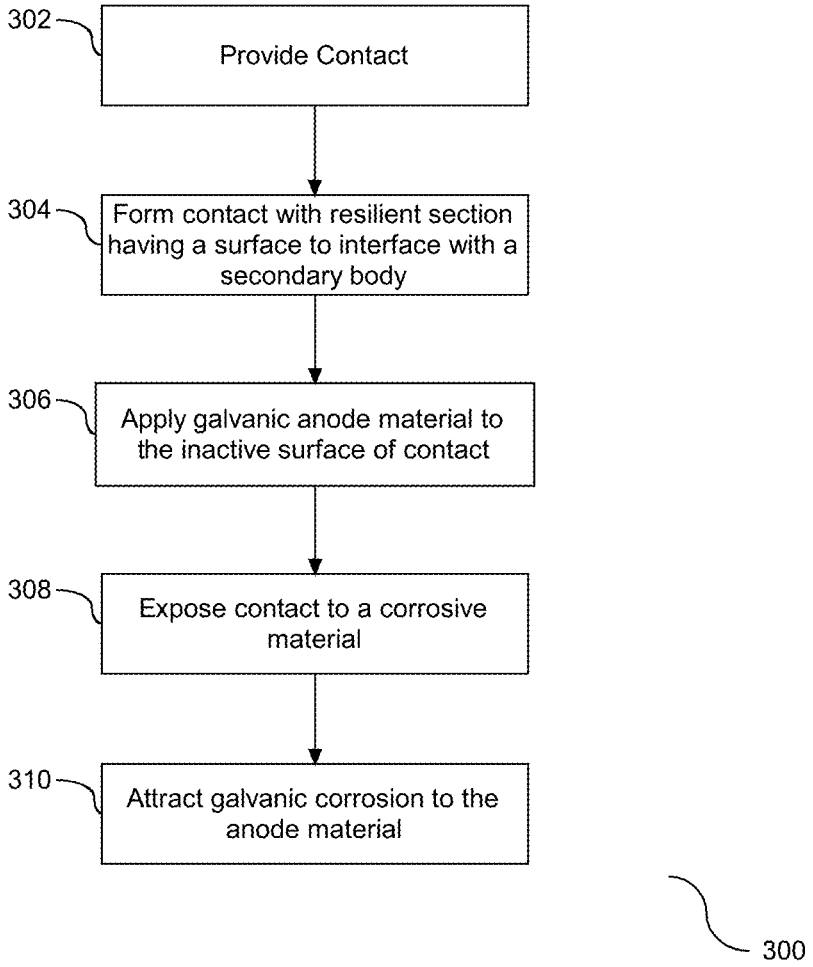
FIG. 3 depicts a flow chart illustrating a process for modifying a cantilever spring contact for an electrical connector to mitigate galvanic corrosion of the connector.

The focus and placement of the sacrificial material (150), shown in FIG. 1, and (250) shown in FIG. 2, is to direct the galvanic corrosion to an inactive area of the body, and more specifically to a material in communication with the inactive area, so that the material (150) and (250), respectively, will be subject to corrosion in place of the body (110). Referring to FIG. 3, a flow chart (300) is provided illustrating a process for modifying a cantilever spring contact for an electrical connector to mitigate galvanic corrosion of the connector. As shown, a cantilever spring contact, hereinafter referred to as a contact, is provided (302). The contact is comprised of a primary material or a composition of materials, wherein the primary material or composition have a propensity for galvanic corrosion. The contact is formed with a resilient section with a first surface to interface with a secondary body, such as a connector, and an oppositely disposed second surface (304). Galvanic anode material is applied to the second (inactive) surface of the contact adjacent to or in communication with the resilient section (306). The galvanic anode material functions as a sacrificial material to attract and absorb galvanic corrosion and to divert the corrosion from the contact. The second surface of the contact is benign as it does not contact with or interface with the connector. In one embodiment, the galvanic anode material applied to the contact is selected from a material that has a greater propensity to corrode than the material or composition of the contact. Accordingly, the galvanic anode material is applied to the contact in a benign location and functions as a passive implementation to direct galvanic corrosion away from an active location of the contact.

The application of the material as demonstrated at step (306) may be applied as a coating. Following step (306), the contact is employed in communication with a connector. Upon exposure of the contact to a corrosive material (308), the galvanic corrosion is attracted to the anode material (310). The attraction of the galvanic corrosion to an alternative material in communication with the contact is a passive implementation to enable the contact to remain intact and functionally supported. Accordingly, the materials applied to the contact divert galvanic corrosion from the active surface of the contact to an inactive area of the contact, and more specifically, to a material applied to the inactive surface.

Figure 4:
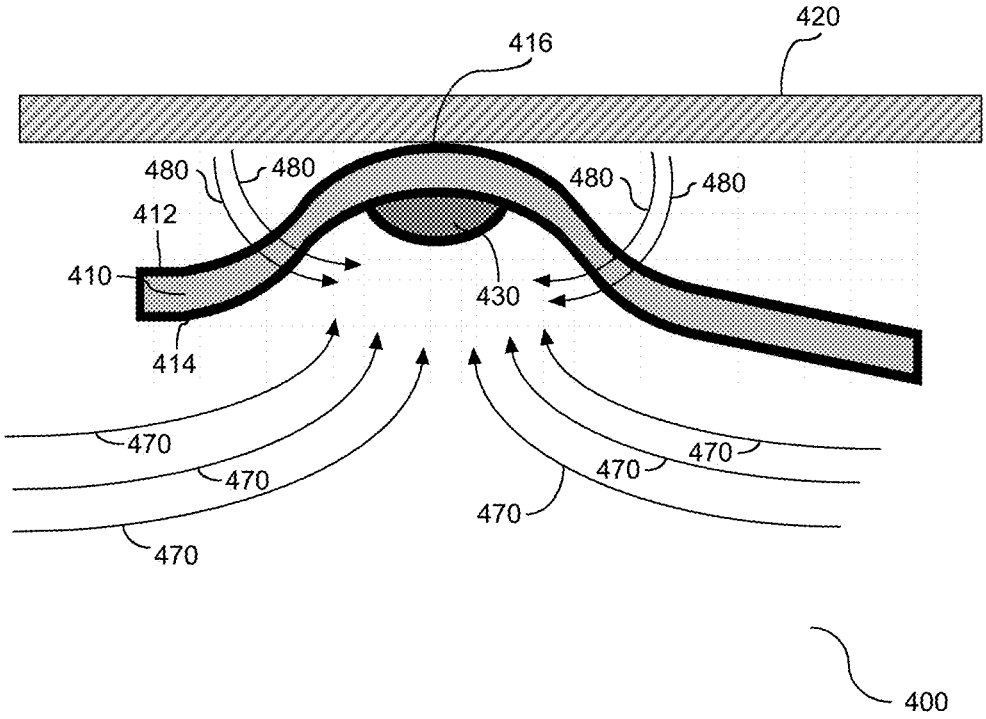
FIG. 4 depicts a flow diagram illustrating the flow of a corrosive medium with respect to the spring contact.

Referring to FIG. 4, a flow diagram (400) is provided illustrating the flow of a corrosive medium with respect to the spring contact. As shown, a spring contact (410) is provided with two oppositely disposed surfaces (412) and (414), respectively referred to as an active surface and an inactive surface. The active surface (412) is shown in communication with a received secondary board (420). Based on the configuration of the contact (410) as a cantilever spring contact, a limited area (416) of the active surface (412) is in communication with the received secondary board (420). In one embodiment, the contact (410) has a resilient property. As further shown, the inactive surface (414) is provided with secondary material (430), also referred to herein as a sacrificial anode material. The secondary material (430) is placed in communication with the inactive surface (414) adjacent to the limited area (416) that receives and remains in contact with the received secondary board (420). In one embodiment, the secondary material (430) is applied as an epoxy coating to the secondary material. The secondary material (430) has a higher propensity to corrode than the primary material of the spring contact.

As shown herein, galvanic corrosion is attracted to the contact (410). More specifically, the flow of the corrosion being attracted to the contact (410) is shown at (470). The application of the secondary material (430) directs the corrosion (470) from the limited area (416) to the secondary material (430). In the embodiment shown herein, the arrows on the corrosion path (470) illustrate the attraction to the secondary material (430), which concurrently diverts the galvanic corrosion from the limited area (416). Since the secondary material (430) is on an inactive surface of the contact, the diversion does not affect the communication or the integrity of the communication and connection between the contact and the secondary board. The attraction of the corrosion to the secondary material causes the secondary material to corrode in place of any galvanic corrosion at the limited area (416). The diversion shown herein (480) illustrates the path of ions directing the corrosion toward the secondary material (430), i.e. the path of ions are attracted to the anode material. It is understood that the diversion paths shown herein are two dimensional representations of an otherwise three dimensional flow. Accordingly, the paths shown herein illustrate a passive implementation of resistance to galvanic corrosion through diversion of incoming flow of a corrosive medium to a sacrificial anode material.

Electrical contacts are designed to meet stringent mechanical and electrical performance specifications. The additional material applied to the contact, such as the sacrificial anode material shown and described above, is applied so as to mitigate any negative effects on the mechanical and/or electrical performance of the contact. As shown and described, in one embodiment, the contact employs cantilever spring geometry with a curved surface adapted to mate with a flat and rigid contact oppositely positioned. The secondary material is applied adjacent to the contact interface, which is the embodiment having a relatively small galvanic cell, and addresses and mitigates the galvanic corrosion proportionally. Application of the secondary material may take place in different application processes, including, but not limited to, cladding, plating, epoxy (also referred to herein as adhesive), or a coating (also referred to herein as a paint).

As shown and described herein, sacrificial anode material is placed on an inactive surface location of a cantilever spring contact. In one embodiment, the sacrificial material is attached to a pin to protect the attached pin from galvanic corrosion. Similarly, in one embodiment, the sacrificial material is attached to a connector shell to protect the integrity of the attached connector shell. In one embodiment, the sacrificial material attached to the connector shell does not protect the pins contained in the connector shell. The sacrificial material directs galvanic corrosion to a specific location on the connector pin, and specifically to the location where the sacrificial anode material is located.

As shown and described herein, the use of the sacrificial material is a passive implementation to mitigate or eliminate galvanic corrosion. No electrical stimulus is applied to enhance galvanic action. More specifically, the extraneous anode material is specifically positioned to mitigate any primary mechanical or electrical properties of the object in receipt of the anode material, while diverting the flow of a corrosive medium to the anode material. The diverted flow mitigates or eliminates galvanic corrosion of the primary contact body.

Aspects of the present invention are described herein with reference to flowchart illustrations and/or block diagrams of apparatus and methods according to embodiments of the invention. The block and flowchart diagrams in the Figures illustrate the architecture, functionality, and operation of possible implementations of apparatus, systems, and methods according to various embodiments of the present invention. In this regard, each block in the flowchart or block diagrams may represent a module, segment, or portion of instructions, which comprises one or more executable instructions for implementing the specified logical function (s). In some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagram(s) and/or flowchart illustration (s), and combinations of blocks in the block diagram(s) and/or flowchart illustration(s), can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Accordingly, the implementation of sacrificial anode material at a relatively benign location mitigates or eliminates galvanic corrosion while enabling the mechanical and/or electrical properties of the body in receipt of the anode material to remain intact.

It will be appreciated that, although specific embodiments of the invention have been described herein for purposes of illustration, various modifications may be made without departing from the spirit and scope of the invention. In particular, use of the sacrificial anode may be employed with non-plated connector pins or contact points. At the same time, the sacrificial anode may reduce pore and creep corrosion that plagues plated connectors and other types of connections that employ a protective coating. In this case, the plating may be thinner, with physical wear being the primary consideration. With respect to alternative applications, such as twist and lock connector shells, the sacrificial anode may be applied adjacent to mating surfaces. For electrical power systems, such as wiring, joining copper wire to aluminum wire results in galvanic corrosion forming between the two materials over time. The sacrificial material may be introduced near the junction point that has a greater rate of corrosion than the wires themselves. Accordingly, the scope of protection of this invention is limited only by the following claims and their equivalents.

What is claimed is:

1. An apparatus comprising:

a first electrical connector cantilever spring contact, the first electrical connector cantilever spring contact comprising:

a primary material with a propensity to corrode, a first proximal end and an oppositely disposed first distal end;

a first resilient section adjacent to the first distal end;

the first resilient section having a first surface, and an oppositely disposed second surface, the first surface positioned to interface with a first secondary contact; and an anode material positioned on the second surface adjacent to a first integral location on the first surface, the anode material to attract galvanic corrosion and divert the galvanic corrosion from the primary material to the anode material.

2. The apparatus of claim 1, further comprising the anode material having an epoxy coating material laced with a second material, the second material having a higher propensity to corrode than the primary material.

3. The apparatus of claim 1, further comprising the anode material to corrode in place of galvanic corrosion on the first surface.

4. The apparatus of claim 1, wherein placement of the anode material is a passive solution to reduce galvanic corrosion.

5. The apparatus of claim 1, wherein the anode material is comprised of a zinc compound.

6. A method comprising:

forming an electrical connector cantilever spring contact having a primary material with a propensity to corrode, the contact having a proximal end and an oppositely disposed distal end;

forming a resilient section adjacent to the distal end, the resilient section having a first surface and an oppositely disposed second surface, the first surface positioned to mate with a received secondary body;

applying an anode material to the second surface adjacent to an integral location on the first surface;

exposing the contact to a corrosive material; and diverting a galvanic corrosive medium from the integral location to the applied anode material.

7. The method of claim 6, further comprising attracting the corrosive medium to the anode material, including the anode material diverting galvanic corrosion from an area on the first surface adjacent to the applied anode material.

8. The method of claim 7, wherein placement of the anode material passively reduces galvanic corrosion from the area on the first surface.

9. The method of claim 7, further comprising corroding the applied anode material in place of the area on the first surface.

10. The method of claim 6, further comprising coating the applied anode material with an epoxy coating material laced with a second material, the second material having a higher propensity to corrode than the primary material of the contact.

11. The method of claim 6, wherein the anode material is comprised of a zinc compound.

12. The method of claim 6, wherein applying the anode material to the second surface adjacent to an integral location on the first surface includes a process selected from the group consisting of: cladding, plating, adhesives, or coatings.

13. An electrical connector comprising:

an electrical connector cantilever spring contract, the contact having a primary material with a propensity to corrode, the contact having a proximal end and an oppositely disposed distal end, the distal end in communication with a substrate;

the contact having a resilient section disposed between the proximal and distal ends;

the resilient section having a first surface adapted to interface with the secondary body, and a second surface oppositely disposed from the first surface; and an anode material selectively positioned in communication with the exterior surface of the contact adjacent to an integral location on the first surface, the anode material to attract a flow of a corrosive medium.

14. The connector of claim 13, further comprising the anode material having an epoxy coating material laced with a second material, the second material having a higher propensity to corrode than the primary material of the contact.

15. The connector of claim 13, further comprising the anode material to attract galvanic corrosion, including a path of ions attracted to the anode material.

16. The connector of claim 15, wherein the attraction of galvanic corrosion to the anode material mitigates corrosion of the primary material of the contact.

17. The connector of claim 15, wherein placement of the anode material is a passive solution to reduce galvanic corrosion.

18. The apparatus of claim 1, further comprising:

a second electrical connector cantilever spring contact electrically insulated from the first electrical connector cantilever spring contact, the second electrical connector cantilever spring contact comprising:

the primary material with a propensity to corrode, a second proximal end and an oppositely disposed second distal end;

a second resilient section adjacent to the second distal end;

the second resilient section having a third surface, and an oppositely disposed fourth surface, the third surface positioned to interface with a second secondary contact; and the anode material positioned on the fourth surface adjacent to a second integral location on the fourth surface, the anode material to attract galvanic corrosion; and an opening positioned between the first and second electrical connector cantilever spring contacts, the opening adapted to receive a secondary body having the first and the second secondary contacts.

19. The apparatus of claim 18, wherein the first integral location of the first electrical connector cantilever spring contact is in physical communication with the first secondary contact and the second integral location of the second electrical connector cantilever spring contact is in physical communication with the second secondary contact.

20. The apparatus of claim 18, further comprising:

a substrate having a first relatively planar contact and a second relatively planar contact, wherein the first proximal end is in communication with the first relatively planar contact, and the second proximal end is in communication with the second relatively planar contact.

* * * * *